US007264380B1

(12) United States Patent
Monroe et al.

(10) Patent No.: US 7,264,380 B1
(45) Date of Patent: Sep. 4, 2007

(54) LIGHT POLLUTION SHIELD

(75) Inventors: Tim E. Monroe, Lincoln, CA (US); John H. Wandrey, Long Beach, CA (US)

(73) Assignee: Jimway, Inc., Rancho Dominguez, CA (US)

( * ) Notice: Subject to any disclaimer, the term of this patent is extended or adjusted under 35 U.S.C. 154(b) by 0 days.

(21) Appl. No.: 11/297,067

(22) Filed: Dec. 7, 2005

(51) Int. Cl.
*F21V 1/06* (2006.01)

(52) U.S. Cl. ..... 362/352; 362/355; 362/356; 362/360; 362/431

(58) Field of Classification Search ..... 362/351, 362/352, 353, 355, 356, 359, 360, 361, 431, 362/276, 802, 374, 375
See application file for complete search history.

(56) References Cited

U.S. PATENT DOCUMENTS 5,057,983 A 10/1991 Ulrich, Sr.
5,311,409 A * 5/1994 King ..... 362/17
5,442,532 A * 8/1995 Boulos et al. ..... 362/276
6,095,665 A 8/2000 Drake et al.
6,305,826 B1 * 10/2001 Yang ..... 362/351
6,322,234 B1 11/2001 Drake et al.
6,709,121 B1 * 3/2004 Lowe et al. ..... 362/18
6,736,530 B2 * 5/2004 Thevenot ..... 362/362
7,152,992 B1 * 12/2006 Monroe et al. ..... 362/147
2003/0026099 A1 * 2/2003 Dutka et al. ..... 362/283
2006/0044812 A1 * 3/2006 Dutka et al. ..... 362/382

* cited by examiner

*Primary Examiner*—Thomas M. Sember
(74) *Attorney, Agent, or Firm*—Paul Y. Feng; Fulwider Patton LLP

(57) ABSTRACT

A lighting system producing a light pattern that is customized in the field by the end user to minimize light pollution. A housing supports a light source that is connected to a power supply. The housing defines an interior chamber. An opaque or low visible light transmissivity shield is bent or formed into a generally tubular shape and is inserted into the chamber surrounding the light source. The shield includes folds, perforations, pre-scoring, grooves, and the like defining sections that can be easily detached to create windows. The windows permit outgoing light to pass while the remaining areas of the shield attenuate or block the outgoing light. The shield includes teeth that engage respective recesses in the housing to prevent rotation of the shield once installed.

19 Claims, 3 Drawing Sheets

LIGHT POLLUTION SHIELD

FIELD OF THE INVENTION

The present invention relates generally to outdoor lighting systems, and in particular, to improved aspects of such lighting systems for directing the light beam that emits from the lighting system.

BACKGROUND OF THE INVENTION

It is common to erect exterior lighting around domestic, industrial, or military property to provide security against intruders, and to provide lighting for visitors and authorized personnel. The need frequently arises for the lighting system to provide a "customized" light pattern, in which a beam of light is desired to be cast in one specific direction, but not in other directions.

In a domestic or residential application where it is common for homes to be built close to each other, the outdoor lighting of one home might project light into a neighbor's home. In the close quarters of some metropolitan areas, such spill over lighting is an irritant, especially if the light illuminates the interior of a neighbor's bedroom during sleeping hours.

To customize the light pattern for such outdoor lighting, one conventional solution is to place a moveable or rotatable shield within the light fixture to block the emitted light with the opaque shield. An example of such a rotating shield is disclosed in U.S. Pat. Nos. 6,095,665 and 6,322,234 (Drake, et al.). When it is desired to change or alter the direction of the blocked light, the user rotates the shield to the desired location. The size and shape of the shield blocking the light in the Drake design is set at the factory and cannot be adjusted in the field. Another rotating light shield in the automotive application is disclosed in, for example, U.S. Pat. No. 5,057,983 (Ulrich, Sr.).

However, a rotatable shield has several disadvantages. One disadvantage is that the shield may be inadvertently moved from its set position by forces such as wind or physical vibration of the supporting structure. Another disadvantage is that shield and attachment hardware are difficult to fabricate and not easily adjusted to precisely block light. Yet another disadvantage is that the shield has a prefabricated shape that is determined during manufacture. Such a predetermined shape does not permit exact tailoring in the field by the consumer to fit the myriad of lighting applications. Thus, such a rotatable shield does not enable the installer or homeowner to truly customize the light pattern by selective blocking the light emission.

Thus, there is a need for a lighting system that provides a light shield whose shape may be customized, during installation in the field, to precisely conform the emitted light to the user's wishes. Further, there is a need for a lighting system that provides a light shield that is of simple construction.

SUMMARY OF THE INVENTION

The present invention is directed to providing a lighting system that is easy to install, and which provides the installer with the option of customizing the illuminated field or light pattern by selectively blocking the light cast by the light source. Thus, the direction, pattern and general intensity of illumination can be custom tailored in the field by the end user to suit the immediate needs of the location where the light is installed. Additionally, once the lighting system is installed and customized to project light of a desired shape, the invention is configured not to allow the shape of the emitted light to be accidentally altered, or to be altered by wind or vibration forces. Further, the size and shape of the light blocking shield is easily adjusted by the end user in the field.

In a preferred embodiment, the invention includes a housing for supporting a light source connected to a power supply. The housing defines an interior chamber and also defines recesses within the chamber. An opaque or darkly-tinted shield is provided, capable of being bent into a generally tubular shape, or optionally being formed in a tubular shape. The shield is insertable within and removable from the chamber when the shield is bent into a generally tubular shape. The shield defines serrations configured to mate with the recesses in the housing, in order to prevent the shield from rotating when it is inserted within the chamber. The shield may be made of metal, plastic, foil covered cardboard, foam, fiberglass, and the like, and its thickness is selected to permit the shield to be manually cut or portions thereof removed to a customized shape. In an alternative embodiment, the housing includes a lip adapted to support the shield within the chamber.

Thus, it will be appreciated that an installer may elect to manually trim the shape or to break off one or more portions thereof to create a window before inserting it within the housing in order to permit light to pass out of the window. Moreover, the installer may insert the shield within the chamber with the window oriented in any direction of his or her choice. The configuration of the invention then locks the shield in position, preventing subsequent rotational movement. These features provide the installer with much flexibility in customizing the shape of the light pattern generated by the lighting system. Further, the simplicity of the present invention light attenuating or blocking system is highly beneficial to ease of manufacture and minimizes component and production costs.

Other features and advantages of the present invention will become apparent from the following detailed description, taken in conjunction with the accompanying drawings, which illustrate, by way of example, features of the invention.

DETAILED DESCRIPTION OF THE PREFERRED EMBODIMENTS

Figure 1:
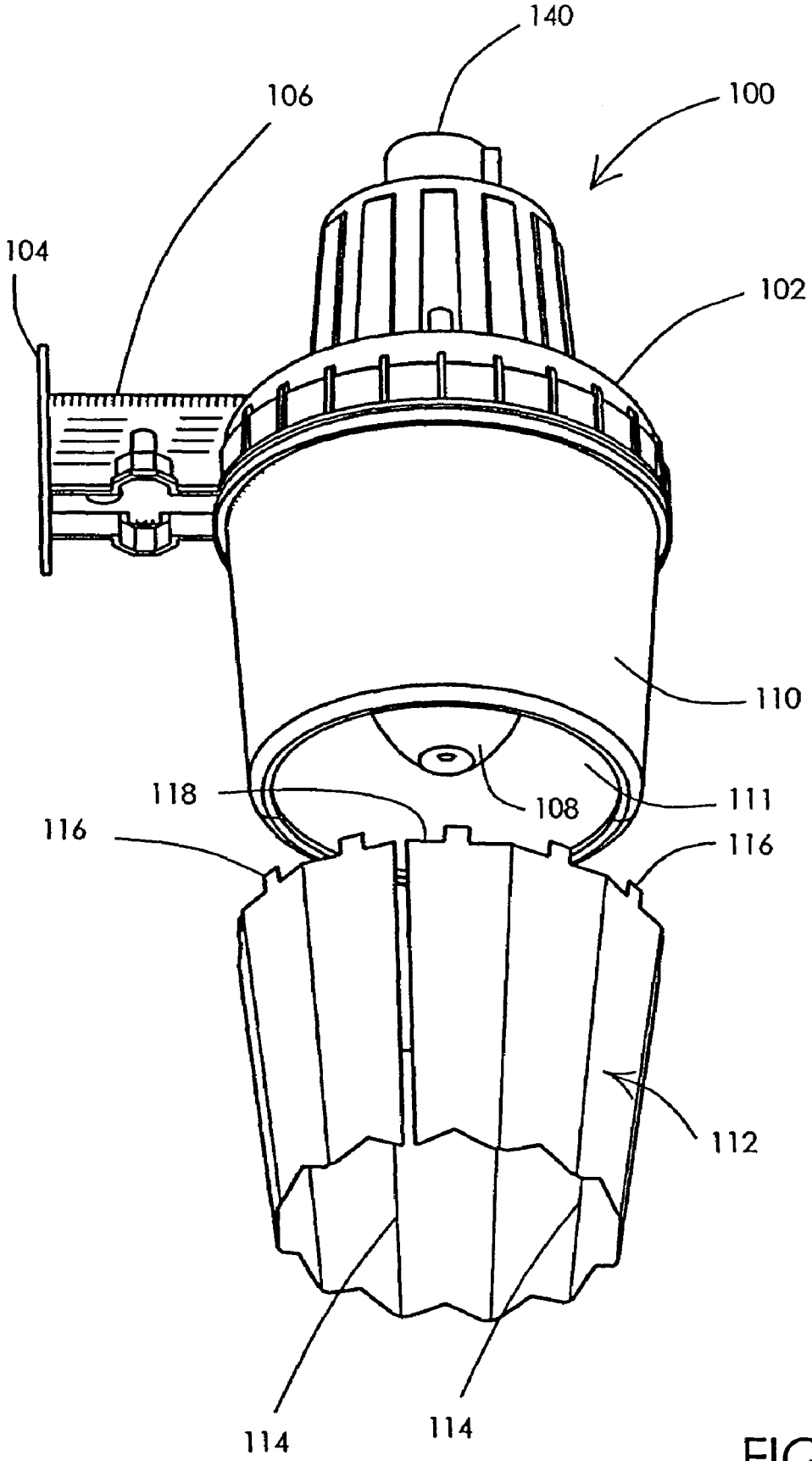
FIG. 1 is a perspective view of a lighting system with a light shield prior to installation.

As shown in the drawing figures, which are provided for purposes of exemplary illustration, the present invention is directed to a lighting system 100. The lighting system 100 benefits from a highly customizable light blocking shield to control light pollution.

Figure 2:
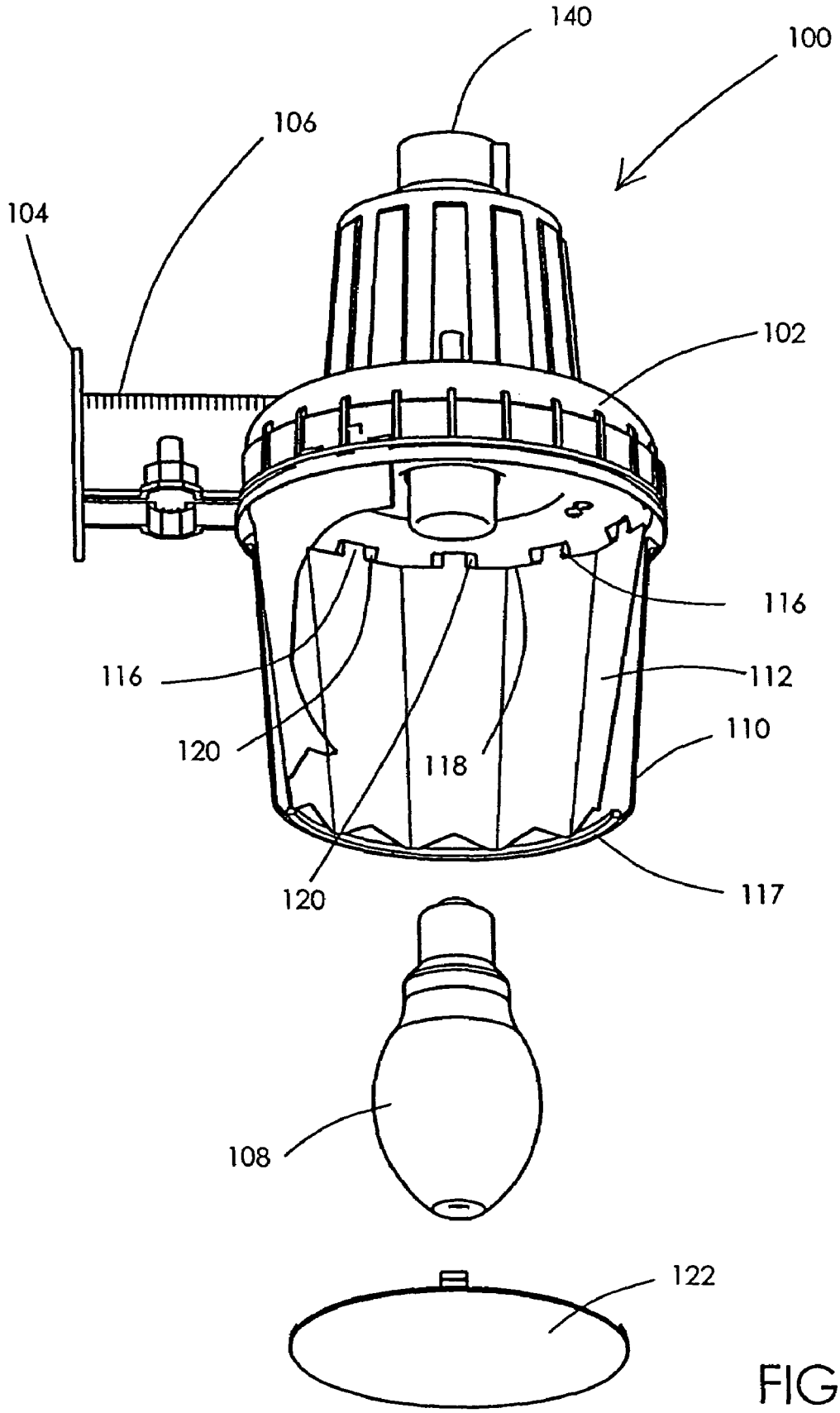
FIG. 2 is partial cutaway perspective view of the lighting system of FIG. 1 showing the light shield installed.

Referring to FIGS. 1-2, forming the central portion of the lighting system 100 is a housing 102 preferably made of a metal such cast iron, steel, aluminum, plastic, or the like. A vertical mounting plate 104 is indirectly attached to or extends from the housing 102 via a horizontal suspension arm 106. The vertical mounting plate 104 is configured to connect the housing 102 to a wall, post, or other permanent support structure. The housing 102 is designed to receive a light source 108, such as an incandescent bulb, neon tube, fluorescent tube, halogen bulb, mercury-vapor element, LED cluster, or the like, which is connected to an AC power supply in the conventional way. The AC power supply is of course optional since the lighting system is easily adaptable to solar power where energy is stored in rechargeable nickel-cadmium or lithium-ion batteries.

While the exemplary embodiment lighting system 100 is shown as a wall mount fixture, it is contemplated that the lighting system 100 can also be configured as a ceiling mount fixture, a post mount fixture, a suspended or hanging fixture, landscape lighting fixture located closer to ground level, and the like.

The housing 102 optionally includes a generally cylindrical, translucent refractor or transparent lens 110 that may be made of molded plastic, glass, or other suitable translucent or transparent or clear material. The lens 110 may have an open bottom as shown in FIG. 1, or the lens 110 may be formed with a closed bottom, or have a covered bottom by addition of a removable cover 122. The lens 110 defines an internal chamber 111 that surrounds the light source 108.

A light shield 112 is inserted within the chamber 111 inside of the cylindrical lens 110 in order to purposely attenuate, block, and/or direct the light emitting through the lens 110. Preferably, the light shield 112 is fabricated from a thin, initially planar sheet of metal, bent or folded along notched, grooved, or otherwise weakened fold lines 114 at regular intervals to produce a generally cylindrical shape that is conveniently manipulated and then inserted into the chamber 111 by the end user in the field. In an alternative embodiment, the light shield 112 may be installed on the exterior of the lens 110.

In various embodiments, the light shield 112 may be fabricated from stamped aluminum, galvanized iron, metal foil covered cardboard or foam, heat resistant plastic, fiberglass, or the like. Ideally, the light shield 112 is completely opaque, or is translucent with a very low amount of transmissivity (e.g., with a dark tint) to greatly limit the intensity of the visible light transmission therethrough. An optionally polished or reflective interior surface of the light shield 112 improves light or lumens output through and around an open bottom lens 110.

The light shield 112 may by corrugated with discrete fold lines 114 as shown in FIGS. 1-2, or it may be a smooth-walled cylinder with rows of perforations, pre-cut or pre-scored lines replacing the fold lines 114. The light shield 112 may further have a vertical split seam as seen in FIG. 1 since it is initially made from a flat sheet of material, and the seam coincides with where the opposed edges meet. Of course, the light shield may also be a round- or polygonal-shape, seamless, integral tube.

Having a preferably tubular formation, the light shield 112 generally controls unwanted light emission in the horizontal direction, which is often where problems of light pollution appear. Typically, the light directed underneath the lamp is not an issue with neighbors. Of course, the present invention lighting system contemplates a shield that can be used to attenuate or block light in the vertical direction as well. In one such alternative embodiment (not shown), the tubular light shield may include upper or lower detachable flaps that bend radially inward to inhibit unwanted light from escaping in the upper or lower directions.

In a preferred embodiment, the shield 112 is configured so that its shape may be easily modified by the electrician or technician carrying out the installation. The modification is accomplished by selectively cutting away or detaching portions of the shield 112 to provide a window of desired size and shape that is then oriented within the lens 110 to permit light to be cast out in that desired direction, intensity, and/or pattern. To ease the formation of the window for passage of light, the fold lines 114 may be intentionally weakened or thinned out areas that cut easily or may be hand separated without using a blade or scissors. Thus, large, generally rectangular sections of the light shield 112 may be removed with ease. Those detached rectangular sections may be contiguous, or may be discrete panels forming alternating windowed and blocked sections in the light shield 112.

In an alternative embodiment, the fold lines 114 may correspond with perforations again permitting easy hand removal of sections of the light shield 112. Preferably, the fold lines, pre-cut or pre-scored lines, perforations 114 run vertically along the height of the shield 112 as seen in FIGS. 1-2. In various alternative embodiment (not shown), the cut lines may extend circumferentially, or may have rectangular, circular, or triangular sections that when detached form correspondingly shaped windows in the shield 112.

Also, the pre-sore or precut lines, perforations, or fold lines may be omitted altogether. Indeed, if the light shield 112 is made from a material such as polyurethane or nylon that is sufficiently thin yet optically opaque sufficiently to block or mostly attenuate visible light, then the electrician or homeowner may simply cut out the window or windows in any shape or size with household scissors or a box-cutter.

Accordingly, the shield 112 may be easily and quickly cut or shaped by hand to form one or more windows that enable the desired amount of light to pass through. It is contemplated that the majority of light be blocked and only one or two windows be formed for light passage, or alternatively, only one or two panels of the shield 112 be used with the remaining panels removed if the user decides that the emanating light need only be blocked in a narrow band, perhaps because of leakage into a nearby neighbor's window. The desired direction or directions of light passage through the window or windows are determined then by the rotational orientation of the shield 112 when it is installed inside the lens 110. The final light pattern and its intensity for the lighting system 100 can thus be customized in the field by the electrician, homeowner, or end user.

To prevent the shield 112 from rotating once it is mounted within the chamber 111, one or more optional teeth or serrations 116 are provided along the top edge 118 of the shield, and adapted to mate with respective recesses 120 in the housing 102 (FIG. 2). The engagement between the teeth 116 of the shield and recesses 120 in the housing has the advantage of preventing the shield 112 from rotating after being inserted within the chamber 111 of the refractor lens 110. Consequently, this feature prevents the direction of the emanating light from being accidentally changed after installation.

An interference or friction fit may be used to hold the teeth 116 within each recess 120, or the parts may be glued together, or they may snap together or hook to each other if the teeth include a bend. Further, the teeth 116 and recesses 120 may be omitted altogether and the springback in the rolled up shield, if made from a resilient material like steel or rubber, causes circumferential expansion against the lens 110 thus holding the shield in place.

Alternatively, to hold the shield 112 within the lens 110, a lip 117 is formed at the bottom edge of the lens 110. The lip 117 is preferably an inward bend providing a circumferential shelf or ledge on which the shield 112 rests. The lip 110 may be used in place of or in addition to the teeth 116 and recesses 120 combination.

To prevent the ingress of dust, insects, snow, rainwater, etc., and to protect a fragile delicate light source such as an incandescent bulb, a snap-on cover 122 may be installed at the bottom end of the lens 110. The cover 112 is preferably made of refractive translucent material the same as the refractor lens 110, but may be opaque, transparent, or may simply be a wire or mesh grill. Of course, if the lens has a bowl shape with an integral bottom, no cover is needed.

Figure 3:
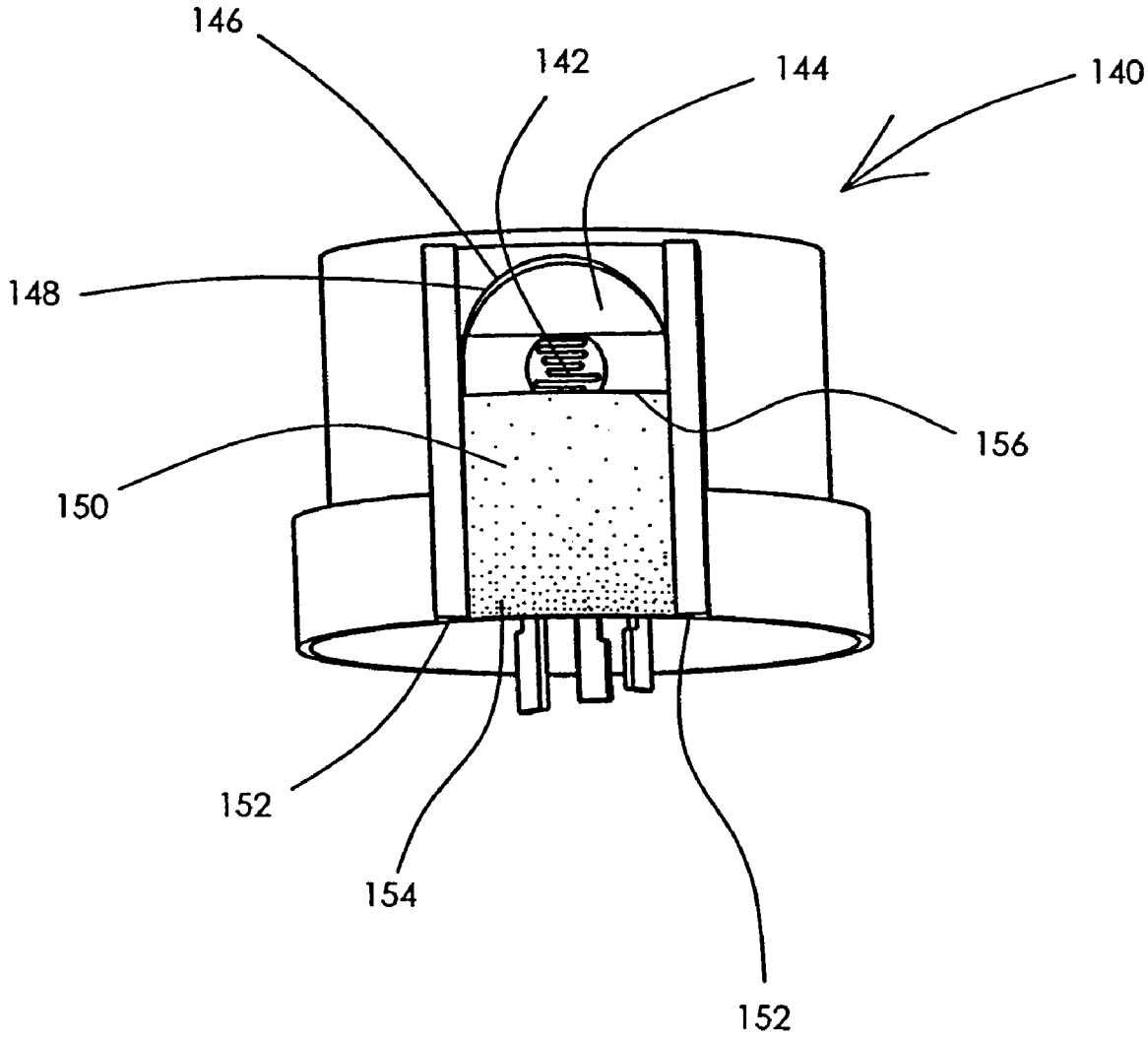
FIG. 3 is a detail view of a photocell used in conjunction with one embodiment of the present invention.

FIG. 3 shows in greater detail an optional photocell 140 mounted on top of the housing 102. Based on ambient lighting conditions, the photocell 140 triggers a switch that controls electrical power for the light source 108. When the level of ambient light falls below a certain level, the photocell 140 switches on the power supply, and when the level of ambient light rises above a certain level, the photocell 140 switches off the power supply to conserve electricity.

The photocell 140 includes a light sensor 142 known in the art, positioned to receive ambient light incident upon the sensor. The sensor 142 may be sheltered within a shallow chamber 144 in the photocell, the chamber defining an opening 146 to admit ambient light. A fixed translucent screen 148 is placed across the opening to protect the sensor 142 from dust, insects, snow, or debris that may settle on the photocell over time. Preferably, the fixed screen 148 is adapted to be cleaned periodically. Additionally, a movable screen 150 may be provided in front of the fixed screen 148 to adjustably shut off ambient light, in part or fully, entering the opening 146, and to thus adjustably obstruct the incidence of ambient light upon the sensor 142. The movable screen 150 may be movably secured to the photocell by providing a pair of slots 152 around the opening, the slots being adapted to hold the edges of the movable screen 150 while at the same time permitting the movable screen to slide vertically up and down to expose or to obstruct the opening.

While in one embodiment the movable screen 150 may be entirely opaque, in a second, preferred embodiment, the movable screen may be opaque at a first end 154, and translucent at a second end 156. Opacity at the first end may be provided by paint applied to the screen which may be made of a translucent material such as plastic. In between the first and the second ends, opacity may gradually fade to translucency. This fading effect may be achieved by applying an ever decreasing thickness of paint on the screen's underlying translucent material toward the second end 156, or, alternatively, by spraying a series of dots of constant thickness on the underlying material, but arranging the dots to have ever decreasing diameters toward the second end, or further alternatively, with ever increasing spacing between the dots toward the second end. The result may resemble shading from dark at the first end to light at the second end such as is known and used in the printing industry.

It will be appreciated that the amount of ambient light entering the chamber to fall upon the sensor 142 may be adjusted by adjusting the vertical position of the movable screen 150 in the slots 152. For example, if the average level of ambient light found in a particular environment is intense, it may be found that the photocell triggers the off switch too late in the evening and too early in the morning. To compensate for such high average levels of ambient light, the position of the movable screen may be set to reduce the amount of light entering the chamber, thereby causing the sensor to trigger the off switch earlier in the evening, and later in the morning. The converse will apply if the average level of ambient light is low. It will be further appreciated that providing the movable screen with graduated shading, as described herein, provides the screen with greater potential sensitivity for adjusting the amount of ambient light that is admitted. For example, without graduated shading, an entirely opaque screen may shut out, say, 10% of the ambient light entering the chamber by moving the screen to shut the opening by only 1 mm. On the other hand, an equivalent screen with graduated shading may shut out 10% of the ambient light entering the chamber by moving it 5 mm. This will allow the user to set the screen to exclude smaller graduated percentages of light, such as 2%, 4%, 6%, etc. by moving it 1 mm for each graduation. It will be appreciated that this aspect will assist the user to adjust the timing of the photocell off and on switch by smaller time intervals.

In an alternative embodiment, the housing containing the photocell 140 may also be used to hold an optional infrared motion detector, which detector controls activation of the light source through electrical systems known in the art. The motion detector housing can optionally be separate from the protocol 140 housing and be located farther forward and in front of on the housing 102 for improved motion sensitivity.

While the specification describes particular embodiments of the present invention, it will also be apparent to those of ordinary skill that various modifications can be made without departing from the spirit and scope of the invention.

We claim:

1. A lighting system providing a light pattern that is customized in the field by an end user, comprising:

a housing containing a light source;

a light shield attenuating visible light passing therethrough, having a tubular shape and multiple sections, wherein the shield is inserted into the housing and at least partially circumscribes the light source;

means for detaching at least one of the multiple sections of the shield disposed along a periphery of the multiple sections, wherein the means for detaching includes a reduced thickness of the shield; and a lens disposed on the housing at least partially covering the shield and light source.

2. The lighting system of claim 1, wherein the shield includes at least one of aluminum, cardboard, fiberglass, and plastic.

3. The lighting system of claim 1, wherein the means for detaching includes a fold line.

4. The lighting system of claim 1, wherein the means for detaching includes a row of perforations.

5. The lighting system of claim 1, wherein the means for detaching includes pre-scoring.

6. The lighting system of claim 1, wherein the housing includes a light sensor controlling a power supply.

7. The lighting system of claim 1, wherein the shield includes teeth and the housing includes recesses receiving the teeth and preventing rotational motion of the shield.

8. The lighting system of claim 1, wherein shield includes a visible light reflective interior.

9. The lighting system of claim 1, wherein the lens includes an open bottom with a circumferential lip supporting the shield thereon.

10. A lighting system providing a light pattern that is customized in the field by an end user, comprising:

a housing having a chamber containing a visible light source;

a lens at least partially covering the visible light source;

a light shield that attenuates visible light passing therethrough, disposed in the chamber surrounding the light source and engaging the housing so that the shield cannot rotate, wherein the shield includes teeth and the housing includes recesses receiving the teeth and preventing rotational motion of the shield; and at least one detachable window formed in the light shield.

11. The lighting system of claim 10, wherein the detachable window includes a fold along at least one edge.

12. The lighting system of claim 10, wherein the detachable window includes a row of perforations along at least one edge.

13. The lighting system of claim 10, wherein the detachable window includes a polygonal shape having opposed edges including rows of perforations coinciding with the edges.

14. The lighting system of claim 10, wherein the light shield attenuates 100% of visible light passing therethrough.

15. The lighting system of claim 10, wherein the light shield includes a plurality of windows with folds coinciding with the edges of the windows.

16. The lighting system of claim 10, wherein the lighting system includes an infrared motion detector incorporated into the housing and controlling the light source.

17. A lighting system providing a light pattern that is customized in the field by an end user, comprising:

an upper housing having a chamber containing a visible light source therein, wherein the chamber includes at least one recess;

a tubular shaped, translucent lens at least partially covering the visible light source and disposed beneath the upper housing;

a light shield that blocks visible light passing therethrough, having at least one tooth extending from a top edge thereof and frictionally engaging the recess thereby inhibiting rotational movement of the shield, and wherein the light shield is disposed in the chamber at least partially surrounding the light source; and at least one detachable window having vertically extending edges formed in the light shield, wherein a fold coincides with each edge.

18. The lighting system of claim 17, wherein the light shield is rolled into a tubular shape from a flat sheet and includes a split seam.

19. The lighting system of claim 17, wherein the light shield includes a plurality of contiguous windows with fold lines dividing the windows.

* * * * *